US008678940B2

(12) United States Patent
Willcox

(10) Patent No.: US 8,678,940 B2
(45) Date of Patent: Mar. 25, 2014

(54) AMUSEMENT PARK RIDE WITH MULTIPLE VERTICAL ROTATION AXES COMBINED WITH VERTICAL TRANSLATION MOTION

(75) Inventor: William W. Willcox, Simi Valley, CA (US)

(73) Assignee: Disney Enterprises, Inc., Burbank, CA (US)

( * ) Notice: Subject to any disclaimer, the term of this patent is extended or adjusted under 35 U.S.C. 154(b) by 190 days.

(21) Appl. No.: 13/431,314

(22) Filed: Mar. 27, 2012

(65) Prior Publication Data

US 2013/0255530 A1 Oct. 3, 2013

(51) Int. Cl.
*A63G 1/28* (2006.01)
*A63G 1/00* (2006.01)

(52) U.S. Cl.
USPC ..... 472/33; 472/35; 472/130

(58) Field of Classification Search
USPC ..... 472/29–32, 35–44, 130; 434/29, 55
See application file for complete search history.

(56) References Cited

U.S. PATENT DOCUMENTS

| | | | | |
|---|---|---|---|---|
| 1,520,592 | A * | 12/1924 | Mongillo | 472/31 |
| 5,192,247 | A * | 3/1993 | Barr et al. | 472/60 |
| 5,395,290 | A * | 3/1995 | Knijpstra | 472/31 |
| 5,558,581 | A * | 9/1996 | Knijpstra | 472/31 |
| 5,597,359 | A * | 1/1997 | Byerly | 472/60 |
| 8,313,389 | B2 * | 11/2012 | Crawford et al. | 472/41 |

* cited by examiner

*Primary Examiner* — Kien Nguyen
(74) *Attorney, Agent, or Firm* — Marsh Fischmann & Breyfogle LLP; Kent A. Lembke

(57) ABSTRACT

A ride combining two or more vertical rotation axes with vertical translation motion of passenger vehicles. The ride includes a primary turntable rotating about a central axis and includes one to three or more secondary turntables mounted on the primary turntable to rotate with the primary turntable. Each of the secondary turntables is driven to rotate about a secondary rotation axis (vertical axis passing through the center of the sub-turntable). Each of the sub-turntables includes a vertical translation motion assembly that rotates with the sub-turntable and also supports a plurality of passenger vehicles. The passenger vehicles are supported within this assembly so as to be able to rotate (via manual operation or in a controlled manner) about a vertical rotation axis passing through the body of the vehicle. The vertical translation motion assembly is configured to allow each passenger vehicle to be lifted vertically upward a distance above the sub-turntable.

18 Claims, 4 Drawing Sheets

AMUSEMENT PARK RIDE WITH MULTIPLE VERTICAL ROTATION AXES COMBINED WITH VERTICAL TRANSLATION MOTION

BACKGROUND

1. Field of the Description

The present description relates, in general, to theme or amusement park rides with rotating platforms or turntables and passenger vehicles that can be manually rotated or rotated in a controlled manner, and, more particularly, to an amusement park ride providing multiple vertical rotation axes to provide desired movement of passenger vehicles and further providing independent vertical translational movement to each of the passenger vehicles.

2. Relevant Background

Amusement and theme parks are popular worldwide with hundreds of millions of people visiting the parks each year. Park operators continuously seek new designs for rides that attract and entertain guests in new ways. Many parks include a teacups ride that is an amusement ride characterized by cup-style spinning vehicles atop a turntable-like floor or platform.

A spinning tea-cup ride may be a ride system that includes a number of small turntables (such as three smaller turntables), which rotate clockwise/counterclockwise about a vertical rotation axis. Each of the turntables holds a number of teacups (such as six teacups or passenger vehicles), and these turntable are mounted onto a large turntable that also rotates, e.g., in the same or differing rotation direction. Further, movement is achieved by allowing the passengers to manually and independently rotate their individual teacups about a vertical rotation axis while their vehicle moves with the large turntable and also with one of the smaller turntables.

In some teacups rides, the ride system simply includes one rotatable platform or turntable with a set of six or another number of teacups or passenger vehicles. Typically, each set of six teacups has a center bearing mounted underneath, similar to a car wheel bearing mounted on a circular floor capable of turning 360 degrees about a vertical axis extending through the teacup/passenger vehicle. The floor or base of the cup sits on a larger turntable-like platform. This turntable or platform is driven by one or more motors through one or more starting devices, and the ride begins to spin slowly and builds up speed as the operator applies more power. When in operation, the ride operator or the passengers then spin each cup while the turntable spins the ride platform/turntable about a center vertical axis. The platform may be driven by a motor fixed or coupled with the platform to rotate the platform or turntable.

While tea cup and similar spinning rides remain popular, amusement park operators continue to search for ways to improve upon and modify the conventional design. Preferably, such a new ride design would build upon the large turntable concept to control the footprint of the new ride as real estate or space within most amusement parks is limited and also make use of well-known and tested propulsion or drive devices for rotating platforms/turntables. Further, existing turntable rides have been limited to a small work space or volume as the rotation platform or rotation platforms/turntables in the "party" ride design have been limited to a single horizontal plane or rotational level (e.g., the tea cups or vehicles rotate on a rotating serving tray or plate). Hence, there remains a need for improved amusement or theme park rides that provide new and unique movements of passenger vehicles (e.g., teacups or other body designs) to entertain park visitors in new and exciting ways.

SUMMARY

The present invention addresses the above problems by providing an amusement park ride that combines two or more vertical or canted spinning or rotation axes with vertical translation motion of passenger vehicles. Briefly, the ride may include a primary turntable or platform that is driven to rotate in a clockwise (or counterclockwise) direction about a central rotation axis (primary rotation axis). The ride further includes one to three or more secondary, smaller-diameter turntables (or sub-turntables) supported by or mounted upon the primary turntable to rotate with the primary turntable about the primary rotation axis. Further, each of the secondary turntables is driven to rotate in a counterclockwise (or clockwise) direction about a secondary vertical or canted rotation axis (vertical axis passing through the center of the sub-turntable).

Significantly, each of the sub-turntables includes a vertical translation motion assembly that rotates with the sub-turntable and also supports a plurality of passenger vehicles. The passenger vehicles are supported within this assembly so as to be able to rotate (via manual operation or in a controlled manner) about a vertical or canted rotation axis passing through the body of the vehicle (e.g., a central axis) such as with a passenger vehicle or seating rotation mechanism. In this manner, the ride provides a plurality of parallel vertical or canted rotation axes (e.g., the primary rotation axis, the secondary vertical or canted rotation axes of the sub-turntables, and the vehicle vertical or canted rotation axes).

Further, the vertical translation motion assembly is configured to allow each passenger vehicle to be lifted vertically upward a distance (1 to 20 feet or more) above the sub-turntable (e.g., above the loading or upper surface of the snip-turntable/platform). The movement typically is along a linear or curved travel or translational path, and this travel path may coincide with the vertical or canted rotation axis of the passenger vehicle. The lift or vertical translation motion may be passenger controlled/initiated with a user input device in the vehicle or may be controlled by the ride control system. In some embodiments, operation of the vertical translation motion assembly provides independent vertical motion of each of the passenger vehicles such that unique ride experiences are provided to the passengers of each vehicle as they can control/affect the spinning and the lifting/lowering of their vehicles.

More particularly, a ride apparatus is provided for adding vertical motion to a rotation-based ride. To this end, the ride apparatus uses a primary turntable assembly including a primary turntable and a drive mechanism that is operable to rotate the primary turntable about a rotation axis, which extends vertically through the primary turntable. The ride apparatus also uses a secondary turntable assembly that is supported upon the primary turntable so as to rotate with the primary turntable about the primary rotation axis. The secondary turntable assembly includes a secondary turntable and a drive mechanism operable to rotate the secondary turntable about a rotation axis extending vertically through the secondary turntable (with the secondary rotation axis being parallel to, or canted with respect to, the first rotation axis).

The ride apparatus includes a plurality of passenger vehicles and, supported on the secondary turntable, a vertical translation motion assembly supporting each of the passenger vehicles. The vertical translation motion assembly is operable to selectively move each of the passenger vehicles vertically relative to an upper surface of the secondary turntable. In some embodiments, each of the passenger vehicles is mounted within the vertical translation motion assembly to rotate about a vehicle rotation axis that is parallel to the rotation axes of the primary turntable and the secondary turntable. In other embodiments, the rotation axis of the vehicle cants with respect to the axis of the secondary turntable.

Further, in some applications, the rotation axis of the secondary turntable is offset a distance from the rotation axis of the primary turntable. Further, it is often useful that each of the passenger vehicles is independently positionable along a travel path by operation of the vertical translation motion assembly (such as in response to passenger input via an input device in the passenger vehicle). To implement the ride apparatus, the travel path may be (or may substantially be) linear and coincide with a vertical or canted rotation axis for a corresponding one of the passenger vehicles. In some particular cases, the ride apparatus is designed such that the body of each of the passenger vehicles is retained in a horizontally level orientation relative to the upper surface of the secondary turntable while being moved vertically by the vertical translation motion assembly.

Further, the vertical translation motion assembly may include a hub mounted on the secondary turntable, lift arms each pivotally attached at a first end to the hub and at a second end supporting one of the passenger vehicles, and one or more lift mechanisms rotating each of the lift arms through a lift angle to vertically position the supported passenger vehicle. In such arm-based embodiments, the lift mechanisms may each include a driver (e.g., a piston element) pivotally mounted at a first end to the upper surface of the secondary turntable and at a second end to the second end to one of the lift arms. In other cases, though, the vertical translation motion assembly may be made up of a scissor lift, spaced apart from the rotation axis of the secondary turntable, for each of the passenger vehicles mounted at a first end to the upper surface of the secondary turntable and supporting one of the passenger vehicles at a second end.

DETAILED DESCRIPTION

Figure 1:
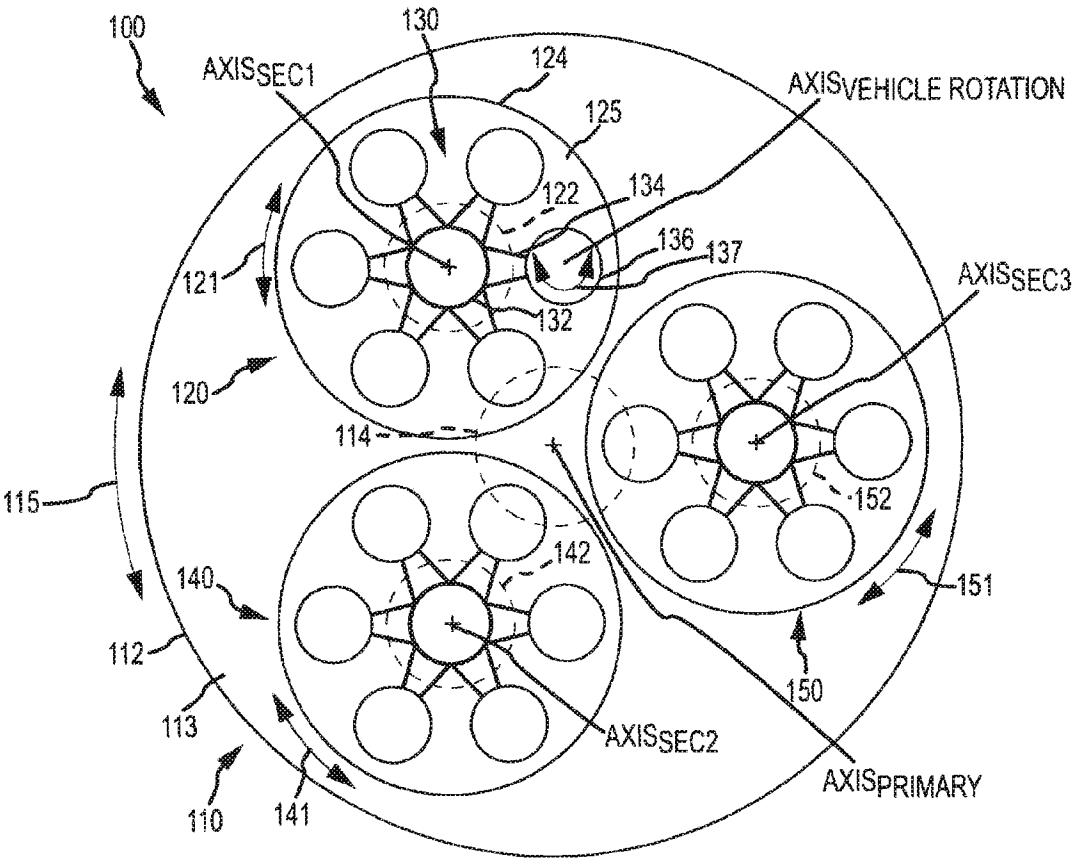
FIG. 1 is a top or plan view of an amusement park ride with a primary (large) turntable and three secondary (smaller) turntables (or sub-turntables) and also with vertical translation motion assemblies supported upon each of the secondary turntables (or sub-turntables) for providing independent vertical movement for each of the passenger vehicles.

Briefly, embodiments of the present invention are directed to systems, and associated methods, for amusement park rides with spinning or rotating passenger vehicles. The rides also are configured to provide vertical movement (vertical translation motion) to move the vehicles in three dimensions (X-Y-Z positioning), which provides a unique ride experience and also increases the volumetric work space of the rides as vehicles are not fixed to rotation on a single horizontal plane.

Briefly, in a ride implementation, a passenger compartment or vehicle is rotatable about a vertical axis (vehicle rotation axis), and the passenger vehicle remains level throughout the ride operations, e.g., a horizontal axis of the vehicle body is perpendicular to the vehicle rotation axis. The passenger vehicle is attached for such rotation in a vertical translation motion assembly, which may include a number of vertically actuated arms raising and lowering the passenger vehicles. In the actuated arm example, the arm may be pivoted through a lift angle of 30 to 45 degrees or more so as to lift the passenger vehicle/compartment from a flat loading position to an elevated position (that may be chosen by a ride control system or by the passenger(s)). In practice, multiple arms (e.g., 2 to 6 or more) may be attached to a central hub, and the arms may be independently actuated to provide independent and differing vertical translation motion to each vehicle/compartment.

The vertical translation motion assembly is affixed to and supported on a secondary turntable or sub-turntable. The secondary turntable is rotated or spun about a vertical axis (secondary rotation axis) by a drive mechanism in either direction (clockwise or counterclockwise). In many embodiments, one to three or more of these sub-turntables are embedded or nested on a primary turntable, which is also driven by a drive mechanism to rotate about a vertical axis (primary rotation axis) in either direction (clockwise or counterclockwise).

The primary turntable is larger than the sub-turntables such as with a first diameter that is 1.5 to 3 times as large as the diameter (second diameter) of the sub-turntables. The vehicle rotation axes, the secondary rotation axes, and the primary rotation axis are parallel to each other, and, in some preferred cases, the vertical movement of each of the vehicles is along a linear path that is also parallel to these rotation axes (e.g., coincident with a corresponding one of the vehicle rotation axes).

The upper surfaces of the primary turntable and the sub-turntables are preferably coplanar or nearly so to facilitate loading and unloading of the passenger vehicles. To allow loading and unloading, the vehicle translation motion assemblies operate to place each of the passenger vehicles upon or just above/adjacent the upper surfaces of the sub-turntables, and passengers can step to and from the sub-turntables at the start and end of each ride or operation of the amusement park ride.

In general, the amusement park rides described herein may be thought of as having a super-imposed, constrained vertical translational motion (up and down movement of each vehicle) on top of two constrained, coplanar vertical axis rotational motions (the primary and secondary turntable rotations). Each ride, therefore, provides an additional degree of motion to a conventional multiple vertical axes rotating/spinning ride, and this imparts a flying sensation to the passenger/rider as well as spinning sensations. The rides achieve this, in part, by providing the vertical translational motion assembly to each sub-turntable of the amusement park ride, and this assembly may include vertical lifting mechanisms, tangential stabilization devices, and radial stabilization devices (or be designed to provide these three functions).

FIG. 1 illustrates a simplistic top (or plan) view of an amusement park ride 100 implementing the idea of superimposing a constrained vertical movement for passenger vehicles also having one to three or more spinning movements. The ride 100 includes a primary turntable assembly 110 and three secondary turntable assemblies 120, 140, 150. The primary turntable assembly 110 includes a primary turntable or platform 112 with an upper surface 113 for loading/unloading of passengers (and safety and aesthetics). The primary turntable 112 may take the form of a planar disk or the like with a first, relatively large diameter (such as 50 to 100 feet or more).

The primary turntable assembly 110 further includes a primary drive mechanism 114 coupled to the primary turntable 112 (e.g., to underside surfaces as shown or to its peripheral surfaces), and the drive mechanism 114 is selectively operable (e.g., via a ride control system (not shown) by wired or wireless communications and/or power supply) to rotate the turntable 112 as shown with arrow 115 in a clockwise or counterclockwise direction about a central rotation axis, $Axis_{Primary}$, shown to extend perpendicular to the upper turntable surface 113. The rate of rotation 115 of the primary turntable 112 typically will be relatively low such as 1 to 3 revolutions per minute or the like.

The ride 100 also includes a number of independently rotating sub-turntables (nested turntables) such as 1 to 3 or more platforms that rotate about rotation axes differing from the primary rotation axis, $Axis_{Primary}$ (e.g., offset some radial distance along the upper surface 113 from the center of turntable 112). As shown, the ride 100 includes secondary turntable assemblies 120, 140, and 150 each with a drive mechanism 122, 142, 152 selectively driving a sub-turntable to rotate 121, 141, 151 in a clockwise or counterclockwise direction about three center rotation axes, $Axis_{Sec1}$, $Axis_{Sec2}$, and $Axis_{Sec3}$. These secondary rotation axes, $Axis_{Sec1}$, $Axis_{Sec2}$, and $Axis_{Sec3}$, are typically parallel to each other and also to the primary rotation axis, $Axis_{Primary}$. The rate of rotation 121, 141, 151 typically is somewhat greater than the rate of rotation 115 such as at 3 to 8 revolutions per minute or the like, and the direction of rotation 121, 141, 151 may be the same or, more typically, opposite that of rotation 115 of the primary turntable 112.

At this point, it may be useful to examine one of the turntable assemblies 120, 140, 150 in more detail. As can be seen with reference to assembly 120, the secondary turntable assembly 120 includes a turntable 124 with an upper surface 125, which may be coplanar with surface 113 of primary turntable 112. The turntable 124 may generally be shaped as a disc with a diameter (second diameter) smaller than the primary turntable (e.g., 15 to 40 feet or the like). The assembly 120 including the secondary turntable 124 is supported upon the primary turntable 112 such that it rotates 115 with the primary turntable 112 about the primary rotation axis, $Axis_{Primary}$. Further, though, the assembly 120 includes a separate drive mechanism 122 that operates concurrently with primary drive 114 to rotate 121 the secondary turntable 124 about the secondary rotation axis, $Axis_{Sec1}$.

Significantly, the secondary turntable assembly 120 includes a vertical translation motion assembly 130 that functions to move passenger vehicles or compartments up and down (e.g., along a linear travel path that may be parallel to the rotation axis, $Axis_{sec1}$). The vertical translation motion assemblies used in ride 100 may be implemented in a variety of ways such as those shown in FIGS. 2A-4B. in the embodiment shown in FIG. 1, the vertical translation motion assembly 130 includes a hub 132 to which a plurality (such as 4 to 8 or more) of lift/support arms that are used to vertically raise passenger vehicles are attached or mounted. The hub 132 may be centrally positioned upon the turntable 124 on or to be extending through the upper surface 125.

As shown, a passenger vehicle 136 is supported at the end of a lift arm 134, which is pivotally coupled to the hub 132, which allows the arm 134 to pivot through a lift angle to raise the vehicle 136 off of the sub-turntable surface 125 while the turntable 124 is spinning 121 (and also with turntable 112 as shown with arrow 115). The passenger vehicle 136 is mounted on the arm 134 such that it can pivot or rotate 137 in either direction about a vehicle rotation axis, $Axis_{Vehicle\ Rotation}$. The vehicle rotation axis, $Axis_{Vehicle\ Rotation}$, passes through the body of the passenger compartment 136 and may be parallel to the rotation axis, $Axis_{Sec1}$, of the turntable 124.

As will be explained, the compartment 136 may be maintained in level or fixed orientation relative to horizontal such as by having the vertical movement of the compartment 136 be along a linear path that is parallel to the vehicle rotation axis, $Axis_{Vehicle\ Rotation}$, (and even coincident with such a rotation axis). The vehicle rotation axis, $Axis_{Vehicle\ Rotation}$, may be considered one of a plurality of tertiary rotation axes provided in the ride 100. The compartment 136 may be considered one of a number of rotation/spin support structures with passenger seating and with manual or automatic control over spinning or rotation 136 about axis, $Axis_{Vehicle\ Rotation}$.

Figure 2A:
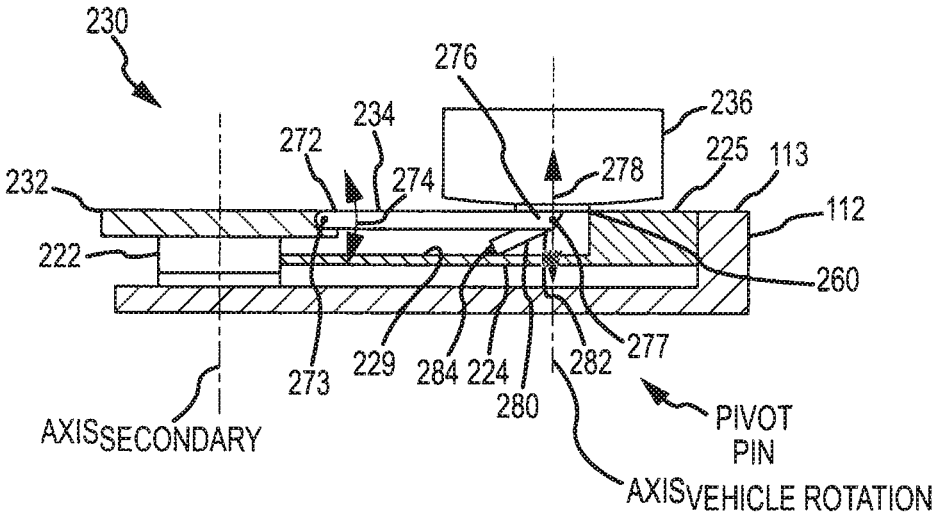
FIGS. 2A and 2B illustrate sectional views of the ride of FIG. 1 taken at line A-A showing an exemplary embodiment of a vertical translation motion assembly in the down and up positions, respectively, as may be utilized in ride of FIG. 1.
Figure 2B:
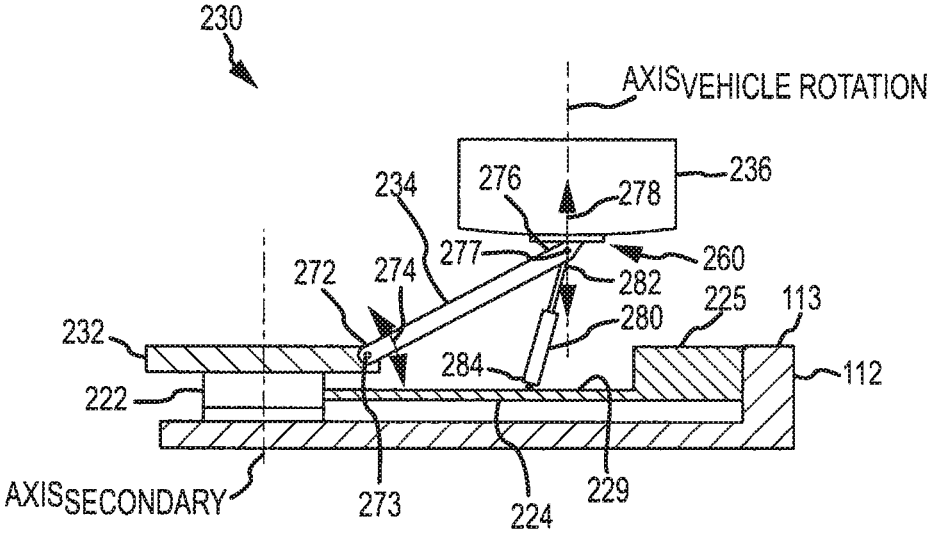

FIGS. 2A and 2B illustrate one embodiment of a vertical translation motion assembly 230 in the down/lowered and up/raised positions, respectively. As shown, the primary turntable 112 supports the assembly 230 via the drive mechanism 222. A hub or center plate 232 is provided on the top of the drive mechanism 222 to rotate about the second rotation axis, $Axis_{Secondary}$, with operation of the drive mechanism 222 and its upper surface may be flush or coplanar with the surfaces 113, 225 to support passenger loading/unloading. The hub 232 may act as a central anchor structure for the portions of the assembly 230 that provide radial/tangential support and stabilization of the vehicle 236. Further, a secondary turntable or sub-turntable 224 is affixed to and extends laterally outward from the drive mechanism 222 also to rotate with the mechanism 222 about the axis, $Axis_{Secondary}$. The turntable 224 may include an upper or loading/unloading surface 225 coplanar or "flush" with the upper surface 113 of the primary turntable 112 to support passenger loading/unloading.

The assembly 230 further includes a lift arm 234 pivotally 274 coupled via pin/shaft 273 to the hub 232 at a first end 272. At the other end 276 of the arm 234, a passenger vehicle or compartment 236 is supported via a compartment mounting assembly 260, which provides for rotation about the vehicle rotation axis or tertiary rotation axis, $Axis_{Vehicle\ Rotation}$, passing through the body of vehicle 236 (e.g., to be parallel to secondary rotation axis, $Axis_{Secondary}$). The mounting assembly 260 may include bearings and rotation elements that allow for manual spinning of the vehicle 236 and/or for rotation in a controlled manner by a ride control system. The end 276 of arm 234 may be pivotally mounted to the assembly 260 with pin/shaft 277.

The assembly 230 includes a lifting mechanism 280 (e.g., a piston or the like) attached at a first end 282 to the mounting assembly 260 or arm end 276 and at a second end 284 to a recessed mounting surface 229 of the secondary turntable 224 (with both ends 282, 284 being able to pivot). In this manner, the vehicle 236 is mounted to rotate with the turntable (or secondary rotation support structure) 224 about secondary rotation axis, $Axis_{Secondary}$. Further, though, the vehicle 236 may be concurrently and independently caused to travel along the linear travel path 278 that defines movement of the vehicle 236. The lifting mechanism 280 may be manually controlled using input from a passenger in the vehicle 236 and/or by ride control systems to provide a particular ride experience and at the end of a ride (lower for unloading/loading).

For example, the piston/lift mechanism 280 operates to raise the vehicle 236 from the down position shown in FIG. 2A to the up position shown in FIG. 2B, and the vehicle 236 (or its body/passenger compartment) moves a distance along the travel path 278 (such as 5 to 20 feet or more above the turntable surfaces 113, 225). The arm 234 pivots 274 about the end 272 mounted to the hub 232 through a lift angle (e.g., 15 to 45 degrees or more as measured from a horizontal plane passing through the hub 232). The combination of the pivotal mounting of arm 234 to the mounting assembly 260 and the configuration of the mounting assembly 260 allows the compartment 236 to remain level such as by having the travel path 278 be substantially wholly vertical (e.g., the travel path 278 is linear and coincident with the vehicle rotation axis, $Axis_{Vehicle\ Rotation}$, or at least substantially parallel to this axis).

Figure 3A:
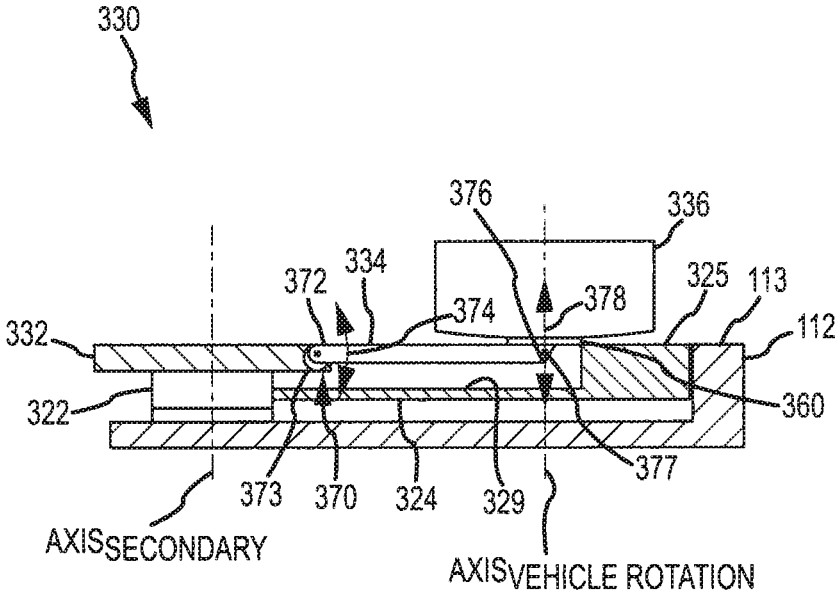
FIGS. 3A and 3B illustrate sectional views of the ride of FIG. 1 taken at line A-A showing a second exemplary embodiment of a vertical translation motion assembly in the down and up positions, respectively, as may be utilized in ride of FIG. 1.
Figure 3B:
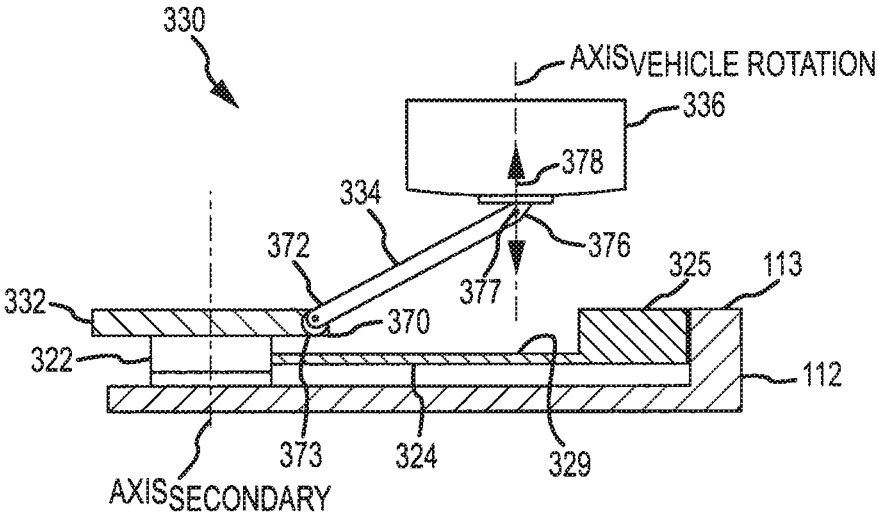

FIGS. 3A and 3B illustrate another embodiment of a vertical translation motion assembly 330 that may be used in ride 100 of FIG. 1 to provide lift or vertical movement to the passenger vehicles. As shown, a drive mechanism 322 of assembly 320 is supported upon primary turntable 112 so that the assembly 320 rotates or moves with the primary or large diameter turntable. Further, the drive mechanism 322 supports a central hub or anchor structure 332 that is rotated in the clockwise or counterclockwise direction about the secondary rotation axis, $Axis_{Secondary}$, by the drive mechanism 322. The hub 332 may have an upper surface flush or coplanar with upper surface 113 of the primary turntable to facilitate loading/unloading.

The assembly 330 includes a lift arm 334 and a secondary turntable 324 that are also both attached to or coupled with the drive mechanism 322 (one indirectly through the hub 332 and one directly via a cantilevered or other arrangement). In this manner, the lift arm 334 and secondary turntable 324 both rotate with the hub 332 in response to operation of the drive mechanism 322 to rotate about the secondary rotation axis, $Axis_{Secondary}$. As shown, the secondary turntable 324 includes an upper surface 325 that is coplanar with or nearly so with upper surface 113 of the primary turntable 112 for use in loading/unloading.

The assembly 330 includes a lifting or arm rotation mechanism 370 on the hub 332, and the arm 334 is attached at a first end 372 via pin/shaft 373 so as to be pivotal 374 through a lift angle (e.g., 15 to 45 degrees or more). The lifting mechanism 370 may be geared or otherwise configured to selectively move 374 the arm 334, and it may be operated manually or in response to passenger input from vehicle 336. At the opposite end 376, the arm 334 supports a passenger vehicle 336 via pivot pin/shaft 377. Again, the arm 334 may be coupled to a vehicle mounting assembly 360 that is adapted to allow the vehicle 336 to pivot or rotate about a vehicle rotation axis, $Axis_{Vehicle\ Rotation}$, and to maintain the vehicle in a level orientation (a horizontal axis or plane of the body remains parallel to surfaces 113, 325). The travel path 378 of the vehicle 336 is generally vertical and along the vehicle rotation axis, $Axis_{Vehicle\ Rotation}$, such that this travel path can be said to be parallel to the rotation axes of a ride incorporating the assembly 330. The arm 334 is moved away from recessed surface 329 such as to position the vehicle 336 between 5 to 20 feet or more above the upper surface 325 of the secondary turntable 324.

Figure 4A:
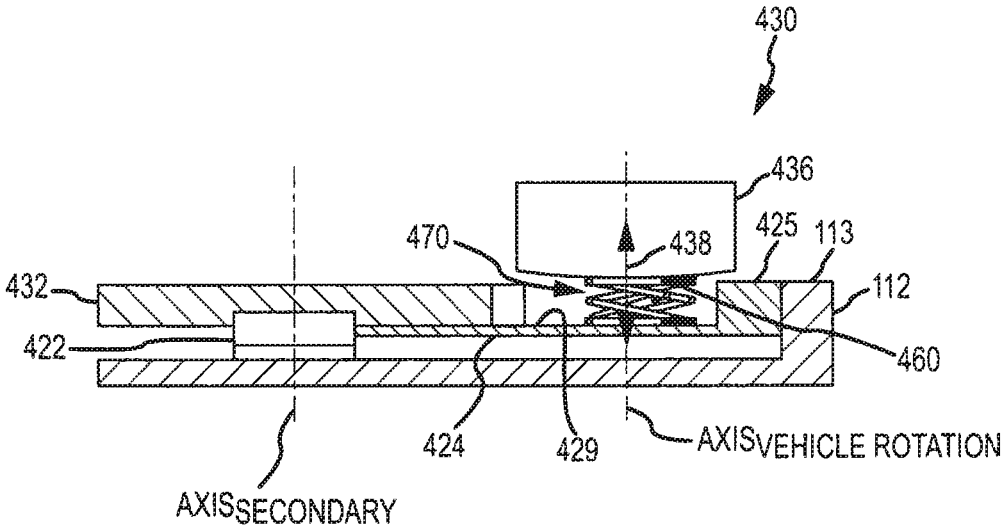
FIGS. 4A and 4B illustrate sectional views of the ride of FIG. 1 taken at line A-A showing a third exemplary embodiment of a vertical translation motion assembly in the down and up positions, respectively.
Figure 4B:
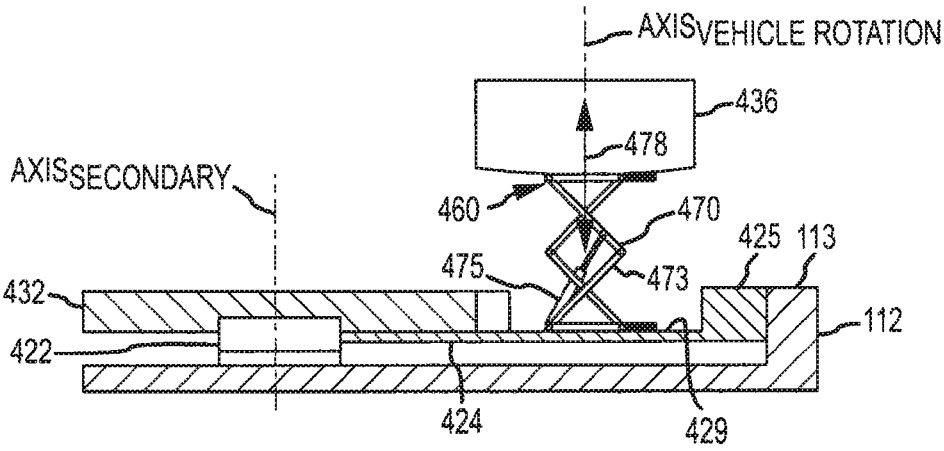

FIGS. 4A and 4B illustrate another embodiment of a vertical translation motion assembly 430 in down and up positions, respectively, as may be used in a ride 100 of FIG. 1. A central hub or support structure 432 is attached to a drive mechanism 422, with the drive mechanism 422 mounted to the primary turntable 112 to rotate the assembly 430 with the turntable 112. A secondary turntable 424 also is affixed to the drive mechanism 422 directly or via the hub 432 so that the secondary turntable rotates with the hub 432 about the secondary rotation axis, $Axis_{Secondary}$, with operation of the drive mechanism 422. The top of the hub 432 and the upper surface 425 of the secondary turntable 424 may be substantially coplanar or flush with the upper surface 113 of the primary turntable 112 to assist with loading/unloading of the vehicle 436.

The assembly 430 includes a lifting mechanism 470 in the form of a scissor lift with legs 473 attached at a first end to a recessed surface 429 of the secondary turntable 424 (e.g., the lifting mechanism 470 rotates with the platform/turntable 424). The legs 473 of the scissor lift 470 are attached at the upper or second end to the vehicle mounting assembly 460, and the mounting assembly 460 is adapted to allow the passenger compartment or vehicle 436 to be manually or automatically/controllably rotated about a vehicle axis of rotation, $Axis_{Vehicle\ Rotation}$, which is vertical and parallel to the secondary rotation axis, $Axis_{Secondary}$.

A piston or similar drive device 475 is provided in the lifting mechanism 470 to selectively cause the legs 473 to accordion in (as shown in FIG. 4A) and out (as shown in FIG. 4B) so as to lower and raise/lift the vehicle 436. This causes the vehicle 436 to move or change its vertical position or height relative to the surfaces 113, 425 (such as from about 0 feet up to 5 to 20 feet or more vertical lift). The travel path 478 is shown to coincide with the vehicle rotation axis, $Axis_{Vehicle\ Rotation}$, and, in this case, to be truly vertical in that it is parallel to all of the rotation axes of a ride using the assembly 430 including axes, $Axis_{Secondary}$ and $Axis_{Vehicle\ Rotation}$. As with the other embodiments, the lifting mechanism 470 may be actuated by a passenger of the vehicle to move 478 the vehicle 436 up and down and/or by ride controls including lowering the vehicle 436 to the load/unload position at the end of a ride as shown in FIG. 4A.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the vehicle rotation axes were generally shown to be vertical in FIGS. 1-4B. However, other embodiments, not shown, may be provided in which the vehicle rotation axes are canted with respect to the axis of the secondary turntable. Likewise, the secondary rotation axes about which the secondary turntables are shown in FIGS. 1-4B to be vertical, but some embodiments, not shown, use canted rotation axes for one or more of the secondary turntables. Hence, one or both of the secondary axes and the vehicle rotation axes may be canted to practice the invention.

The ride systems provide a number of advantages when compared with existing rides. The delivered capacity is a favorable feature of the rides system compared with the area and cost required for many typical amusement park rides. External facilities and show portions are optional, and minimal show sets would be needed to implement the rides. Larger turntables yield larger capacities, but there is a small increase in load and unload time if a single holding queue is used. Scalability up and down to fit existing real estate is another attractive feature of the ride design.

Power and communication to the arms or other portions of the vertical translation motion assemblies may be provided via slip rings or roll rings. A ride control system (not shown) may be used as is well known to selectively operate the turntable drive mechanisms to pick rotation rates and/or directions and/or to operate the vertical translation motion assemblies (e.g., to lower the passenger vehicles at the ends of rides or to set vertical movements to suit a ride experience when vertical movement is not solely manually controlled by the passengers).

In some cases, the vertical translation motion assembly components such as a lift arm and/or one or more actuators may be concealed by portions of the supporting sub-turntable when the ride is not operating or moving. As the arm or other vertical lift devices raise the vehicle, they become visible above the upper surface of the sub-turntable. There is an opportunity to "reveal" decoration or animation associated with each arm or other lift mechanism as it raises and lowers a passenger compartment. The ride should be relatively inexpensive to develop and provides the benefit of well-known loading/unloading processes as well as a small footprint.

I claim:

1. A ride apparatus, comprising:

a primary turntable assembly including a primary turntable and a drive mechanism operable to rotate the primary turntable about a rotation axis extending vertically through the primary turntable;

supported on the primary turntable, a secondary turntable assembly including a secondary turntable and a drive mechanism operable to rotate the secondary turntable about a rotation axis extending vertically through the secondary turntable;

a plurality of passenger vehicles; and supported on the secondary turntable, a vertical translation motion assembly supporting each of the passenger vehicles and selectively moving each of the passenger vehicles vertically relative to an upper surface of the secondary turntable.

2. The ride apparatus of claim 1, wherein each of the passenger vehicles is mounted within the vertical translation motion assembly to rotate about a vehicle rotation axis that is parallel to the rotation axes of the primary turntable and the secondary turntable.

3. The ride apparatus of claim 1, wherein the rotation axis of the secondary turntable is offset a distance from the rotation axis of the primary turntable.

4. The ride apparatus of claim 1, wherein each of the passenger vehicles is independently positionable along a travel path by operation of the vertical translation motion assembly.

5. The ride apparatus of claim 4, wherein the travel path is substantially linear and substantially coincides with a vertical rotation axis for a corresponding one of the passenger vehicles.

6. The ride apparatus of claim 1, wherein a body of each of the passenger vehicles is retained in a horizontally level orientation relative to the upper surface of the secondary turntable while being moved vertically by the vertical translation motion assembly.

7. The ride apparatus of claim 1, wherein the vertical translation motion assembly comprises a hub mounted on the secondary turntable, lift arms each pivotally attached at a first end to the hub arid at a second end supporting one of the passenger vehicles, and one or more lift mechanisms rotating each of the lift arms through a lift angle to vertically position the supported passenger vehicle.

8. The ride apparatus of claim 7, wherein the lift mechanisms each comprise a driver pivotally mounted at a first end to the upper surface of the secondary turntable and at a second end to the second end to one of the lift arms.

9. The ride apparatus of claim 1, wherein the vertical translation motion assembly comprises a scissor lift, spaced apart from the rotation axis of the secondary turntable, for each of the passenger vehicles mounted at a first end to the upper surface of the secondary turntable and supporting one of the passenger vehicles at a second end.

10. An amusement park ride, comprising:

a primary turntable rotating, during operation of the ride, at a first rate and in a first direction about a primary rotation axis extending vertically through the primary turntable;

supported on the primary turntable, a secondary turntable rotating independently of the primary turntable, during operation of the ride, at a second rate and hi a second direction about a secondary rotation axis extending through the secondary turntable, the secondary rotation axis being offset a distance from the primary rotation axis;

a plurality of passenger vehicles; and supported on the secondary turntable, a motion assembly supporting each of the passenger vehicles for rotation about a vehicle rotation axis, the motion assembly selectively moving each of the passenger vehicles relative to coplanar upper surfaces of the primary and secondary turntables, wherein the motion assembly comprises a lift arms each pivotally attached at a first end to the upper surface of the secondary turntable and at a second end supporting one of the passenger vehicles and the motion assembly further comprises one or more lift mechanisms rotating each of the lift arms through a lift angle to vertically position the supported passenger vehicle.

11. The amusement park ride of claim 10, wherein secondary rotation axis is a vertical axis parallel to the primary rotation axis or is canted relative to the primary rotation axis.

12. The amusement park ride of claim 10, wherein the lift mechanisms each comprises a piston mechanism pivotally mounted at a first end to the upper surface of the secondary turntable and at a second end to the second end to one of the lift arms.

13. An amusement park ride, comprising:

a primary turntable rotating, during operation of the ride, at a first rate and in a first direction about a primary rotation axis extending vertically through the primary turntable;

supported on the primary turntable, a secondary turntable rotating independently of the primary turntable, during operation of the ride, at a second rate and in a second direction about a secondary rotation axis extending through the secondary turntable, the secondary rotation axis being offset a distance from the primary rotation axis;

a plurality of passenger vehicles; and supported on the secondary turntable, a motion assembly supporting each of the passenger vehicles for rotation about a vehicle rotation axis, the motion assembly selectively moving each of the passenger vehicles relative to coplanar upper surfaces of the primary and secondary turntables, wherein secondary rotation axis is a vertical axis parallel to the primary rotation axis or is canted relative to the primary rotation axis, and wherein the motion assembly comprises a scissor lift, spaced apart from the rotation axis of the secondary turntable, for each of the passenger vehicles mounted at a first end to the upper surface of the secondary turntable and supporting one of the passenger vehicles at a second end.

14. A ride providing spinning and flying ride experiences, comprising:

a primary turntable assembly including a primary turntable and a drive mechanism operable to rotate the primary turntable about a central rotation axis extending vertically through the primary turntable;

supported on the primary turntable, a plurality of secondary turntable assemblies each including a secondary turntable and a drive mechanism operable to rotate the secondary turntable about a rotation axis extending through the secondary turntable and radially offset from the central rotation axis of the primary turntable;

a plurality of passenger vehicles; and supported on each of the secondary turntables, a vertical translation motion assembly supporting each of the passenger vehicles and selectively moving each of the passenger vehicles vertically relative to an upper surface of the secondary turntable.

15. The ride of claim 14, wherein each of the passenger vehicles is mounted within the vertical translation motion assembly to rotate about a vehicle rotation axis that is parallel to the rotation axes of the primary turntable and the secondary turntable and wherein each of the passenger vehicles is independently positionable along a vertical travel path, by operation of the vertical translation motion assembly, while being retained in a horizontally level orientation.

16. The ride of claim 15, wherein the vertical travel path is substantially linear and substantially coincides with a vertical rotation axis for a corresponding one of the passenger vehicles.

17. The ride of claim 14, wherein the vertical translation motion assembly comprises a hub mounted on the secondary turntable, lift arms each pivotally attached at a first end to the hub and at a second end supporting one of the passenger vehicles, and one or more lift mechanisms rotating each of the lift arms through a lift angle to vertically position the supported passenger vehicle.

18. The ride of claim 14, wherein the vertical translation motion assembly comprises a scissor lift, spaced apart from the rotation axis of the secondary turntable, for each of the passenger vehicles mounted at a first end to the upper surface of the secondary turntable and supporting one of the passenger vehicles at a second end.

* * * * *

UNITED STATES PATENT AND TRADEMARK OFFICE

CERTIFICATE OF CORRECTION

PATENT NO. : 8,678,940 B2
APPLICATION NO. : 13/431314
DATED : March 25, 2014
INVENTOR(S) : William W. Willcox It is certified that error appears in the above-identified patent and that said Letters Patent is hereby corrected as shown below:

In the Claims

Column 9 lines 51-57
Please replace Claim 7 with the following:

The ride apparatus of claim 1, wherein the vertical translation motion assembly comprises a hub mounted on the secondary turntable, lift arms each pivotally attached at a first end to the hub and at a second end supporting one of the passenger vehicles, and one or more lift mechanisms rotating each of the lift arms through a lift angle to vertically position the supported passenger vehicle.

Column 10 lines 1-26
Please replace Claim 10 with the following:

An amusement park ride, comprising:
a primary turntable rotating, during operation of the ride, at a first rate and in a first direction about a primary rotation axis extending vertically through the primary turntable; supported on the primary turntable, a secondary turntable rotating independently of the primary turntable, during operation of the ride, at a second rate and in a second direction about a secondary rotation axis extending through the secondary turntable, the secondary rotation axis being offset a distance from the primary rotation axis;
a plurality of passenger vehicles; and
supported on the secondary turntable, a motion assembly supporting each of the passenger vehicles for rotation about a vehicle rotation axis, the motion assembly selectively moving each of the passenger vehicles relative to coplanar upper surfaces of the primary and secondary turntables,
wherein the motion assembly comprises a lift arms each pivotally attached at a first end to the upper surface of the secondary turntable and at a second end supporting one of the passenger vehicles and the motion assembly further comprises one or more lift mechanisms rotating each of the lift arms through a lift angle to vertically position the supported passenger vehicle.

Signed and Sealed this
Fourth Day of November, 2014

Michelle K. Lee

Michelle K. Lee
*Deputy Director of the United States Patent and Trademark Office*